United States Patent [19]

Lin

[11] Patent Number: 4,662,665

[45] Date of Patent: May 5, 1987

[54] AUXILIARY LOCK WITH AN EXTENSIBLE DEVICE

[76] Inventor: Jui C. Lin, 297,Box Ay Road, Kaohsiung, 800

[21] Appl. No.: 815,893

[22] Filed: Jan. 3, 1986

[51] Int. Cl.[4] ..... E05C 1/16; E05C 21/02

[52] U.S. Cl. ..... 292/167; 292/337

[58] Field of Search ..... 292/167, 337, DIG. 60, 292/1; 70/143

[56] References Cited

U.S. PATENT DOCUMENTS

| | | | |
|---|---|---|---|
| 1,661,454 | 3/1928 | Wilson | 292/337 X |
| 2,613,094 | 10/1952 | Schlage | 292/167 X |
| 3,036,850 | 5/1962 | Schmid | 292/337 X |
| 4,372,594 | 2/1983 | Gater | 292/DIG. 60 X |
| 4,422,677 | 12/1983 | Gater | 292/167 X |
| 4,446,707 | 5/1984 | Mullich et al. | 292/DIG. 60 X |

*Primary Examiner*—Richard E. Moore

*Attorney, Agent, or Firm*—Holman & Stern

[57] ABSTRACT

This invention relates to an auxiliary lock which has a base, a rotating shell, and an extending shell that, through the hooks, grooves, and notches disposed thereon, can connect selectively together in a short or long position and is therefore able to change the distance between a rotating member and the faceplate of the lock via adjustment of the rotating shell.

5 Claims, 9 Drawing Figures

AUXILIARY LOCK WITH AN EXTENSIBLE DEVICE

BACKGROUND OF THE INVENTION

An auxiliary lock is an extra reinforcing device used for attachment to a door, in addition to an ordinary latching knob-actuated lock, for safety. When fixing this lock in a door, a long latitudinal groove needs to be cut on the side surface of a door so as to fit the lock in. A turning hole then is cut in the front surface of the door to fit with an intersecting "crossed hole" of the lock. The "crossed hole" is a rotatable member having a cross-shaped opening.

Usually, locks nowadays manufactured have a certain definite distance between its crossed hole and faceplate. So users have to properly select the size of a lock according to the structure of a door (namely, the length of the long latitudinal groove in the door) that the lock is to be fixed on. But, in order to satisfy different needs, manufacturers have to make auxiliary locks of different sizes, retailers are obliged to devote more space for storing them, and besides, buyers may feel at a loss in selecting them.

SUMMARY OF THE INVENTION

In order to solve the problems in the art mentioned above, the present invention has been worked out to provide auxiliary locks to alter the distance between its crossed hole and the faceplate, depending on the door it is to be mounted upon.

DETAILED DESCRIPTION OF THE INVENTION

Figure 1:
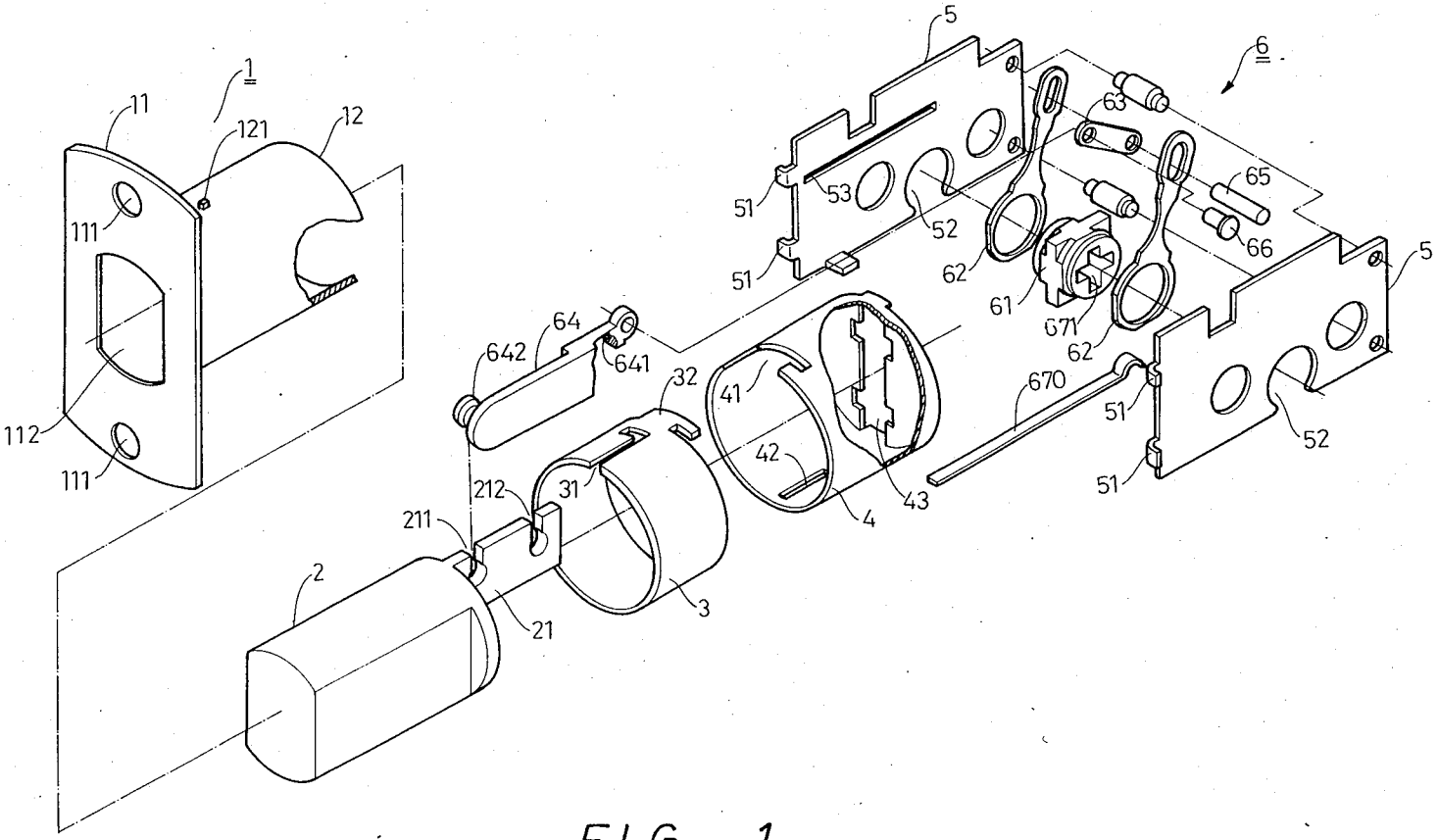
FIG. 1 is an assembly view of the auxiliary lock of the present invention.

As shown in the FIG. 1, an extensible lock includes a base 1, a dead bolt 2, a rotating shell 3, an extending shell 4, assembling plates 5 and moving accessories 6.

The base 1 is composed of a faceplate 11 and a cylinder 12. The faceplate 11 has two holes 111 which are to be bolted through to fix the auxiliary lock in a door. An opening 112 is cut between the holes 111 and used for the dead bolt 2 to extend therethrough. On both the upper- and the under-surface of the cylinder 12 there are respective humps 121, 122 (hump 122 is shown in FIG. 7). The hump 121 functions to restrict the position of the rotating shell 3. The hump 122 functions to guide the extending shell 4 as shown in the FIGS. 6 and 7.

The extending shell 4 is formed with a notch 41 to lock up with the hook 32 of the rotating shell 3 and with a groove 42 for the hump 122 to fit in guiding its travel. Also, an opening 43 is formed in the shell 4 to combine the shell 4 itself with the assembling plates 5 and the moving accessories 6. The "moving accessories" refer to the movable parts used to move the dead bolt 2, including numbered parts 61–66.

The assembling plates 5,5 are two similar plates which, via hooks 51 integral therewith, are retained in the opening 43 of the extending shell 4. Each of the assembling plates 5,5 is symmetrically arranged with a hole 52, therein enabling a rotating member 61 to rotate within the holes 52,52. In addition, a straight groove 53 cut into one of the assembling plates 5, 5 enables a guiding projection 641 (shown clearly in FIG. 1 and 2) of a linking plate 64 to move back and forth along the groove 53.

The moving accessories 6 include a rotating member 61, two arms 62, two linking plates 63, 64, pin 65, and pin 66. They are assembled as follows. The arms 62, 62 are placed on each side of the rotating member 61, cylindrical projections (unnumbered) of member 61, are placed in the holes 52 of the assembling plates 51. Then the arms 62 and the linking plate 63 are connected with a pin 65, and the two linking plates 63, 64 are connected with a pin 66. While the rotating member 61 is to rotate, the linking plate 64 is bound to move in linear motion, since the pin 641 of the linking plate 64 is confined in the groove 53. The pin 642 on the linking plate 64 can be selectively locked in the notch 211 or 212 of the arm 21 by manipulation of the linking plate 64 so that the dead bolt 2 can be moved outward or back to the original position. The rotating member 61 has a cross-shaped opening 671 therethrough adapted to receive a shaft or tool end (or even a key or the like if desired) to cause rotation of said rotating member 61. Rotation of the rotating member 61 can also be accomplished by manipulation of arms 62,62 as seen by FIGS. 6 and 7.

Figure 2:
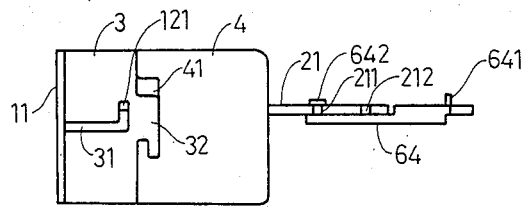
FIG. 2 is an upper view of the auxiliary lock invention adjusted to a first position having a short size.
Figure 3:
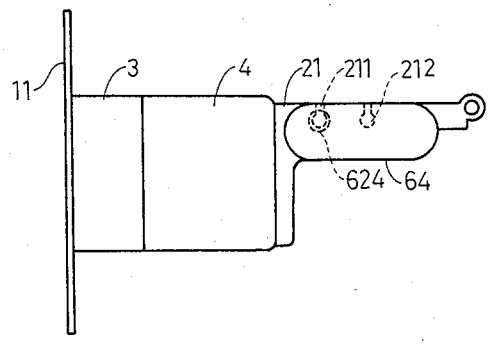
FIG. 3 is a front view of the auxiliary lock of the present invention adjusted to the first position having a short size.

As seen in FIGS. 2 and 3, when the rotating shell 3 is adjusted to make the end of the slot 31 move toward the hump 121, and the pin 642 of the linking plate 64 is locked in the notch 211 of the arm 21, the distance between the axis of the rotating member 61 and the faceplate 11 is relatively short, and corresponds to a first position.

Figure 4:
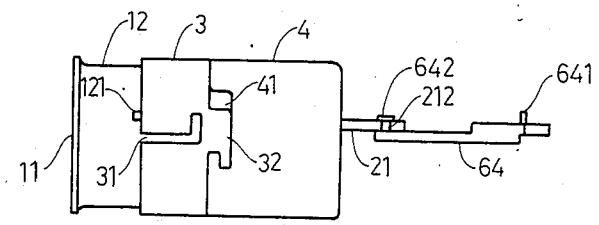
FIG. 4 is an upper view of the auxiliary lock of the present invention adjusted to a second position having a long size.
Figure 5:
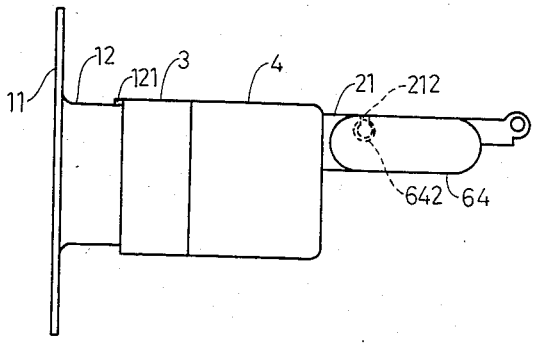
FIG. 5 is the front view of the auxiliary lock adjusted to the second position having a long size.

Next, as seen in FIGS. 4 and 5, when the rotating shell 3 is adjusted to make its left edge abut the hump 121, and the pin 642 of the linking plate 64 is locked in the notch 121 of the arm 21, the distance between the crossed hole of the rotating member 61 and the faceplate is then relatively long and corresponds to a second position.

Figure 6:
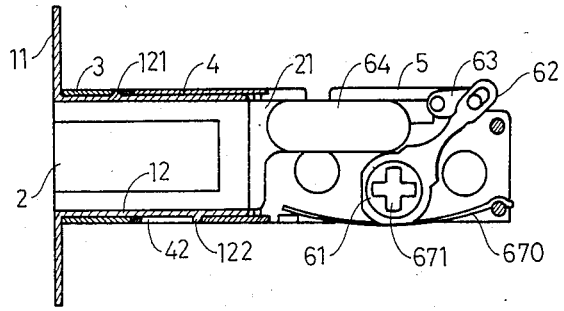
FIG. 6 is a cross-sectional view of an opened state of the auxiliary lock adjusted to its short size.
Figure 7:
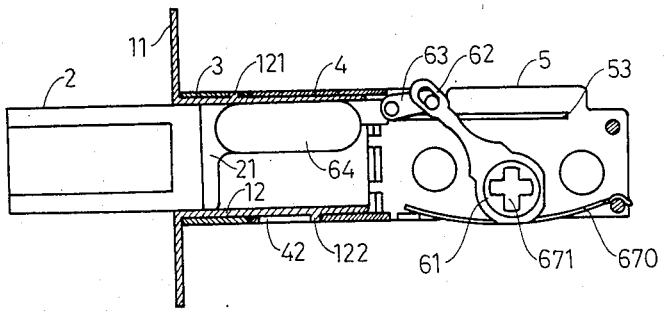
FIG. 7 is a cross-sectional view of a closed state of the auxiliary lock adjusted to its short size.

The inward or outward motion of the dead bolt 2 is shown in the FIGS. 6 and 7. As the member 61 is turned about its axis, the arms 62 are also rotated and force the dead bolt 2 to selectively move along the cylinder 12 outwards and back, such that the dead bolt 2 is either entirely within the cylinder 12 or protruding outside the cylinder 12, through the action of the linking plates 63, 64. A leaf spring 670 is seen to latch the flats of the rotating member 61.

Figure 8A:
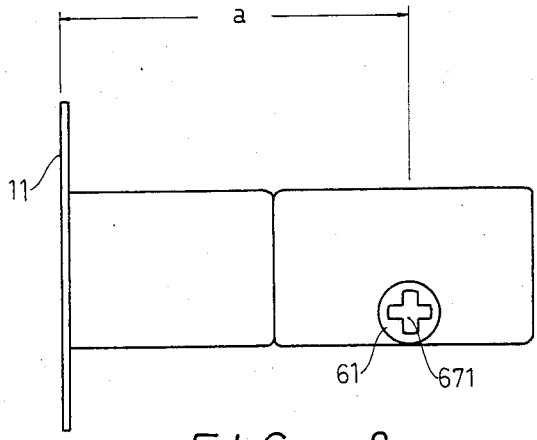
FIG. 8(*a*) is a view showing the fixing of the auxiliary lock in a first position, and FIG. 8(*b*) is a view showing the fixing of the auxiliary lock in a second position.
Figure 8B:
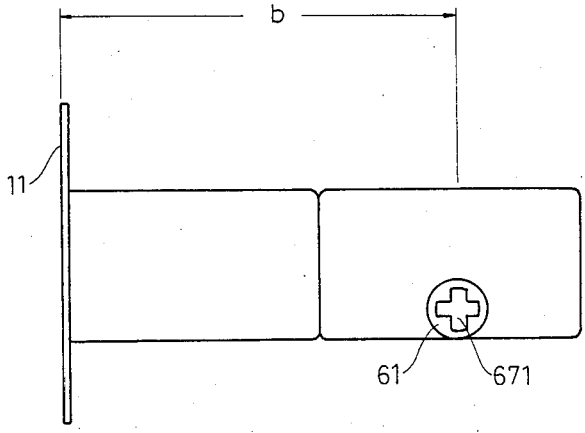

The above-described embodiment of the present invention provides that the distance between the rotating member 61 and the faceplate 11 is changeable to two different positions, the short one and the long one, via the movement of the assembly 6 within the rotating shell 3 and the extending shell 4, relative to the notiches 211, 212. This changes the position of the rotating shell 3 which is guided along by means of the hump 121, and by locking the pin 642 of the linking plate 64 selectively in one of the notches 211 or 212 of the arm 21, so as to meet different lock length requirements in mounting a lock within a door. This is shown in FIGS. 7, and 8(*a*), and 8(*b*), the short position having the length "a" in FIG. 7, and the long position having the length "b".

What is claimed is:

1. An auxiliary lock with an extensible portion which can be assembled in one of two different positions, comprising:

a base which includes a faceplate adopted to be fixed upon a door;

a cylinder connected to one side of said faceplate;

a rotating shell coaxially disposed about said cylinder and slidable axially relative thereto, said rotating shell having an axis and a peripheral edge; an extending shell connected to said rotating shell, and having an axis which is generally colinear with said axis of said rotating shell; said cylinder having at least one projecting hump adapted to restrict the position of the rotating shell and to guide said extending shell in linear motion; a dead bolt having an arm that has therein a first notch and a second, distal, notch; said rotating shell having an L-shaped slot and a hook, said rotatable shell being adapted to be moved relative to the hump of the cylinder along said slot; said hook being adapted to restrict the position of the extending shell by the hook; said extending shell having a notch receiving said hook of said rotating shell and having a groove therein for guiding said extending shell in sliding motion in a generally straight line; said extending shell having an opening on an end thereof receiving a pair of assembling plates and receiving moving accessories;

said assembling plates being fixed to said extending shell;

said plurality of assembling plates cooperating with said moving accessories, each of said assembling plates having a hole therein for receiving a rotatable member;

said moving accessories including at least one arm pivotably connected to a first linking plate; said first linking plate being pivotably connected to a first portion of a plate being pivotably connected to a first portion of a second linking plate;

said second linking plate having a pin disposed on a second portion thereof;

in a first position, said pin of said second linking plate being disposed within said first notch of said arm of said deadbolt, and said hump of said cylinder abutting said peripheral edge of said rotating shell;

in a second position, said pin of said second linking plate being disposed within said second, distal notch of said arm of said deadbolt, and said hump being disposed within a base portion of said L-shaped slot in said rotating shell;

whereby said assembling plates can be disposed at a first depth or a second depth within a door, said first and second depth corresponding respectively to said first and second positions.

2. An auxiliary lock as claimed in claim 1, further comprising a faceplate, fixedly connected to one end of said cylinder.

3. An auxiliary lock as claimed in claim 1, wherein said rotating member is resiliently biased by a leaf spring;

said rotating member being stably retained in two positions by said leaf spring.

4. An auxiliary lock as claimed in claim 3, wherein said rotating member has at least two flat surfaces thereon adapted for contacting said leaf spring;

moving accessories which include a rotating member supported by two arms at each side thereof, said rotating member having portions thereof disposed within said holes of said assembling plates; a pin for connecting said linking plate with another linking plate; and a third pin fixed on said another plate which can selectively lock in one of said two notches in said dead bolt;

whereby the length of the lock can be changed to two positions, a first short position and a second position, by changing the position of said rotating shell relative to said cylinder.

5. An auxiliary lock as claimed in claim 1, wherein said rotating member has a generally cross-shaped opening therethrough.

* * * * *